US012636542B2

(12) United States Patent
Prochnik

(10) Patent No.: US 12,636,542 B2
(45) Date of Patent: May 26, 2026

(54) MAT AND SUPPORT STRUCTURE

(71) Applicant: Ethan Prochnik, Los Angeles, CA (US)

(72) Inventor: Ethan Prochnik, Los Angeles, CA (US)

(73) Assignee: Kinshe LLC, Los Angeles, CA (US)

( * ) Notice: Subject to any disclaimer, the term of this patent is extended or adjusted under 35 U.S.C. 154(b) by 0 days.

(21) Appl. No.: 18/836,126

(22) PCT Filed: Aug. 18, 2023

(86) PCT No.: PCT/US2023/030525

§ 371 (c)(1),
(2) Date: Aug. 6, 2024

(87) PCT Pub. No.: WO2024/039813

PCT Pub. Date: Feb. 22, 2024

(65) Prior Publication Data

US 2025/0135269 A1 May 1, 2025

Related U.S. Application Data

(60) Provisional application No. 63/399,176, filed on Aug. 18, 2022.

(51) Int. Cl.
*A63B 21/00* (2006.01)

(52) U.S. Cl.
CPC ..... *A63B 21/4037* (2015.10); *A63B 2210/50* (2013.01)

(58) Field of Classification Search
CPC ..... Y10T 428/24008; Y10T 428/24017; Y10T 428/24479; Y10T 428/24496;
(Continued)

(56) References Cited

U.S. PATENT DOCUMENTS 3,434,715 A * 3/1969 Brantingham ..... A63B 21/4037 482/79
6,751,816 B1 * 6/2004 Wechsler ..... A47G 9/062 383/4

(Continued)

FOREIGN PATENT DOCUMENTS

CN 106377869 A 2/2017
CN 209967519 U * 1/2020

(Continued)

OTHER PUBLICATIONS

Machine translation (Espacenet) of DE 20 2018 002 541 U1. Translated Mar. 5, 2025. (Year: 2025).*

(Continued)

*Primary Examiner* — Maria V Ewald
*Assistant Examiner* — Ethan A. Utt
(74) *Attorney, Agent, or Firm* — Danielson Legal LLC

(57) ABSTRACT

Mats and methods of manufacturing the same. The mat includes a first mat portion; and at least one support structure including a first attachment portion configured to operably connect with the first mat portion, a first side to support a user, a second side opposite the first side and configured to be in operable contact with a surface separate from the mat, wherein the second side includes at least one ridge portion to enable the support structure to be in a rolled configuration with the first mat portion.

17 Claims, 6 Drawing Sheets

(58) Field of Classification Search
CPC ..... Y10T 428/24504; Y10T 428/24512; Y10T 428/2457; Y10T 428/24612; Y10S 428/906; B32B 3/00; B32B 3/26; B32B 3/30; B32B 5/00; B32B 5/18; B32B 7/00; B32B 7/04; B32B 7/06; B32B 7/08; B32B 7/09; B32B 7/12; B32B 2471/00; B32B 2471/04; A63B 6/00; A63B 21/00; A63B 21/40; A63B 21/4027; A63B 2209/00; A63B 2209/08; A63B 2209/10; A63B 2209/14; A63B 21/4037; A47G 27/00; A47G 27/02; A47G 27/0212
USPC ..... 428/99, 100, 156, 158, 159, 160, 167, 428/172, 906, 910; 5/417, 420, 652, 5/655.9, 922; 482/142, 148
See application file for complete search history.

(56) References Cited

U.S. PATENT DOCUMENTS

| | | | | |
|---|---|---|---|---|
| 6,935,382 | B2 | 8/2005 | Buckley | |
| 2006/0040811 | A1 | 2/2006 | Foster | |
| 2015/0297941 | A1 * | 10/2015 | Fleming | A63B 21/4037 5/417 |
| 2016/0007787 | A1 * | 1/2016 | Johnson | A47G 27/0231 428/58 |
| 2016/0030799 | A1 * | 2/2016 | Sutherland | A63B 21/4037 5/420 |
| 2018/0042420 | A1 * | 2/2018 | Johnson | A47G 27/0231 |
| 2020/0315385 | A1 * | 10/2020 | Johnson | B32B 3/06 |

FOREIGN PATENT DOCUMENTS

| | | | | |
|---|---|---|---|---|
| DE | 202018002541 | U1 * | 8/2018 | A47C 27/146 |
| EP | 0294378 | B1 * | 7/1991 | A61G 1/01 |
| WO | 2016027109 | A1 | 2/2016 | |
| WO | WO-2019014377 | A1 * | 1/2019 | E04F 19/06 |

OTHER PUBLICATIONS

Machine translation (Espacenet) of CN 209 967 519 U. Translated Mar. 8, 2025. (Year: 2025).*
International Search Report for PCT/US2023/030525, Dec. 7, 2023. 2 pages.
Written Opinion for PCT/US2023/030525, Dec. 7, 2023. 5 pages.

* cited by examiner

MAT AND SUPPORT STRUCTURE

CROSS REFERENCE TO RELATED APPLICATIONS

The present application is the national stage of International (PCT) Patent Application No. PCT/US2023/030525, filed internationally on Aug. 18, 2023, and claims the benefit of and priority to U.S. provisional application No. 63/399,176, filed on Aug. 18, 2022, the disclosures of each of which are incorporated by reference as if set forth in their entirety herein.

TECHNICAL FIELD

Embodiments described herein generally relate to mats and, more particularly but not exclusively, to exercise mats and related components.

BACKGROUND

Exercise cushions or mats have become a common piece of equipment for a variety of exercises. These exercises may include, but are not limited to Yoga, Pilates, stretching, martial arts, circuit training, Tai Chi, high-intensity interval training (HIIT), or the like.

Existing exercise cushions or mats are typically formed as a single piece of material, which does not offer much structural support or stability for the user or the mat. Additionally, these existing, single-piece cushions or mats generally do not provide the user with an exciting user experience.

A need exists, therefore, for improved mats and methods of manufacturing the same.

SUMMARY

This summary is provided to introduce a selection of concepts in a simplified form that are further described below in the Detailed Description section. This summary is not intended to identify or exclude key features or essential features of the claimed subject matter, nor is it intended to be used as an aid in determining the scope of the claimed subject matter.

According to one aspect, embodiments relate to a mat. The mat includes a first mat portion; and at least one support structure including a first attachment portion configured to operably connect with the first mat portion, a first side to support a user, a second side opposite the first side and configured to be in operable contact with a surface separate from the mat, wherein the second side includes one or more portions that define at least one groove to enable the support structure to be in a rolled configuration with the first mat portion.

In some embodiments, the first attachment portion includes an attachment surface to operably connect the first mat portion.

In some embodiments, the first side includes a plurality of ridges to support the user. In some embodiments, the first side is compressible during support of the user, and the second side provides structural support during support of the user.

In some embodiments, the first side includes a smooth portion to support the user.

In some embodiments, the surface is a floor portion.

In some embodiments, the mat further includes a hinged portion between the attachment portion and at least one of the first side or the second side to enable the support structure to be in the rolled configuration with the mat portion.

In some embodiments, the at least one support structure is formed from at least one of thermoplastic elastomer, thermoplastic polyurethane, polyurethane, silicon, urethane, rubber, natural rubber, or cork.

In some embodiments, the at least one support structure and the first mat portion are operably connected via at least one of stitching, an adhesive, hook and loop fasteners, a mechanical attachment mechanism, magnets, or rivets.

In some embodiments, the first side of the support structure is shaped as an arch.

In some embodiments, the at least one support structure further comprises at least one gripping element configured with the second side to removably secure the support structure to the surface.

In some embodiments, the second side includes a plurality of portions that define a plurality of grooves between each of the portions to enable the support structure to be in the rolled configuration with the mat portion.

In some embodiments, the mat further includes a second mat portion, wherein the at least one support structure further includes a second attachment portion configured to operably connect with the second mat portion.

In some embodiments, the mat further includes at least a second support structure including an attachment portion configured to operably connect with the first mat portion, a first side to support the user, and a second side opposite the first side and configured to be in operable contact with the surface, wherein the second side includes one or more portions that define at least one groove to enable the second support structure to be in a rolled configuration with the first mat portion and the first support structure.

According to another aspect, embodiments relate to a support structure for a user. The support structure includes an attachment portion configured to operably connect with a mat portion, a first side comprising an arched surface to support the user, and a second side opposite the first portion and including one or more portions that define at least one groove to enable the support structure to be in a rolled configuration.

In some embodiments, the attachment portion includes an attachment surface to operably connect with the mat portion.

In some embodiments, the support structure is formed from at least one of thermoplastic elastomer, thermoplastic polyurethane, polyurethane, silicon, urethane, rubber, natural rubber, or cork.

In some embodiments, the support structure further includes a hinged portion to create a fold point between the attachment portion and the first side or between the attachment portion and the second side.

In some embodiments, the mat further includes a second attachment portion to operably connect the support structure with a second mat portion.

In some embodiments, the mat further includes at least one gripping element configured with the second side to removably secure the support structure to a floor portion.

BRIEF DESCRIPTION OF DRAWINGS

Non-limiting and non-exhaustive embodiments of the invention are described with reference to the following figures, wherein like reference numerals refer to like parts throughout the various views unless otherwise specified.

DETAILED DESCRIPTION

Figure 1:
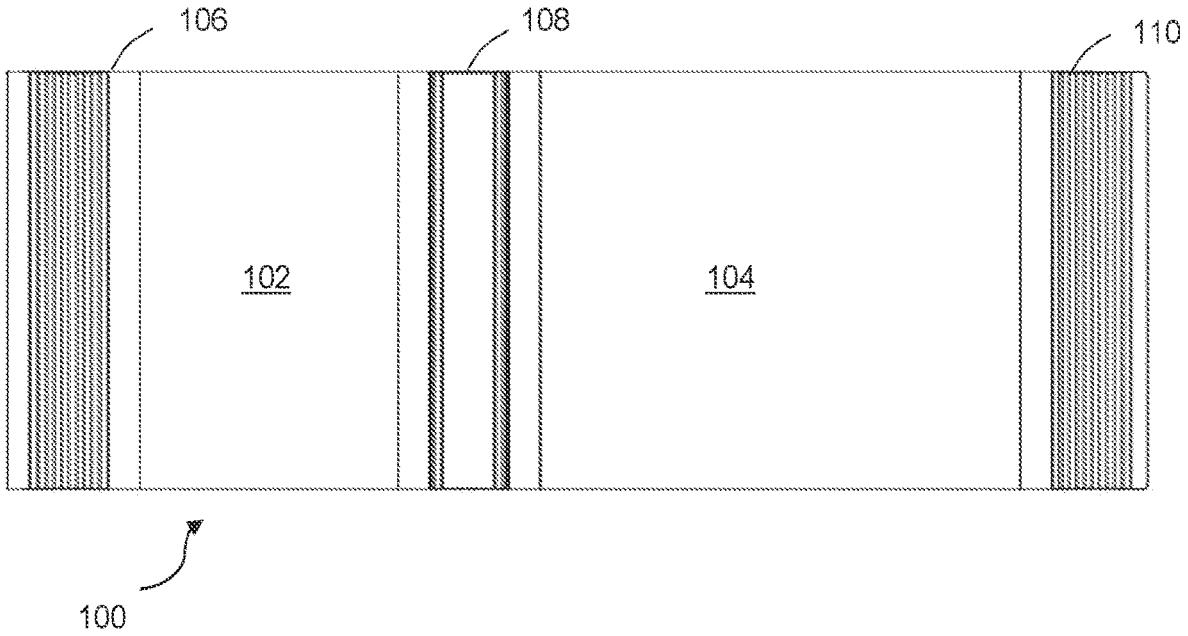
FIG. 1 illustrates top view of a mat in accordance with one embodiment.

Various embodiments are described more fully below with reference to the accompanying drawings, which form a part hereof, and which show specific exemplary embodiments. However, the concepts of the present disclosure may be implemented in many different forms and should not be construed as limited to the embodiments set forth herein; rather, these embodiments are provided as part of a thorough and complete disclosure, to fully convey the scope of the concepts, techniques and implementations of the present disclosure to those skilled in the art.

Reference in the specification to "one embodiment" or to "an embodiment" means that a particular feature, structure, or characteristic described in connection with the embodiments is included in at least one example implementation or technique in accordance with the present disclosure. The appearances of the phrase "in one embodiment" in various places in the specification are not necessarily all referring to the same embodiment.

In addition, the language used in the specification has been principally selected for readability and instructional purposes and may not have been selected to delineate or circumscribe the disclosed subject matter. Accordingly, the present disclosure is intended to be illustrative, and not limiting, of the scope of the concepts discussed herein.

As discussed above, existing exercise mats are typically formed from a single piece of flat material. Even though these cushions may vary in thickness, material, texture, etc., they generally do not provide an exciting user experience. Additionally, and as stated previously, existing single-piece mats do not provide much support or stability for the user. For example, the support provided by a mat may be limited by the material and thickness of the mat, and may further diminish after repeated use.

Some existing mats include supports or cushions that are strategically positioned on the mat. These cushions may require a separate cover portion to receive or otherwise hold the cushions, or the cushions may be integrated with the mat. However, positioning the supports on the mat increases the volumetric footprint of the mat, and makes it difficult to fold or otherwise roll the mat for transport or storage.

The embodiments described herein provide novel mats and related components, as well as methods for manufacturing the same. The mats in accordance with the described embodiments include one or more support structures that help support or otherwise stabilize a user. The support structure(s) may be operably positioned with respect to one or more mat portions so that a user may contact the support structures (e.g., with their hands, fingers, palms, elbows, back, neck, knees, feet, etc.) during use.

The support structure(s) may include one or more grooved or ridge portions. These portions not only provide comfort, stability, support, and an improved tactile experience for the user, but also allow a user to maneuver the mat into a rolled configuration.

In the context of the present application, "rolled configuration" may refer to a configuration in which the support structure(s) has a radius of curvature that increases at approximately the same rate as that of the mat portion(s). Additionally, the height, thickness, compressibility, etc., of the support structure(s) should be such that the mat can be rolled similarly to how a mat made of a single, uniform material would be rolled.

This is in contrast to existing mats, such as those with cushions directly attached to or integrated onto the mat. Although a user may technically fold or roll these mats to some degree, these cushions would prevent these existing mats from being rolled as neatly and compact as if the existing mat was made from and included only a single, uniform material.

Although the present application largely discusses mats in the context of exercise equipment, the features of the described embodiments may be implemented in other applications. For example, and without limitation, other applications in which a user wants comfort or support while in various positions may benefit from the described embodiments. These may include, but are not limited to, applications in plumbing, carpentry, vehicle maintenance or repair, appliance repair, construction, acupressure massage, reflexology, meditation, activities associated with the practice of religion, physical therapy, podiatry, or the like. The above list is merely exemplary, and the features of the described embodiments may be implemented in other applications in addition to or in lieu of those listed above and described herein.

FIG. 1 illustrates a top view of a mat 100 in accordance with one embodiment. The mat 100 may include a first mat portion 102, a second mat portion 104, and support structures 106, 108, and 110. In this embodiment, the mat 100 may be intended for use as part of a floor exercise such as yoga, stretching, or Pilates. Accordingly, the support structures 106-110 may be sized and positioned such that a user would contact the support structures 106-110 while in positions or during movements common in the applicable activity.

The first mat portion 102 may be formed from an any suitable material. For example, and without limitation, the first mat portion 102 may be formed from a thermoplastic elastomer (for simplicity, "TPE"), polyurethane ("PU"), thermoplastic polyurethane ("TPU"), natural rubber, rubber, foam, vinyl, polyester synthetic materials, PVC, thermoplastic elastomers, or some combination thereof. The second mat portion 104 may be similar to the first mat portion 102 in this regard.

Figure 2:
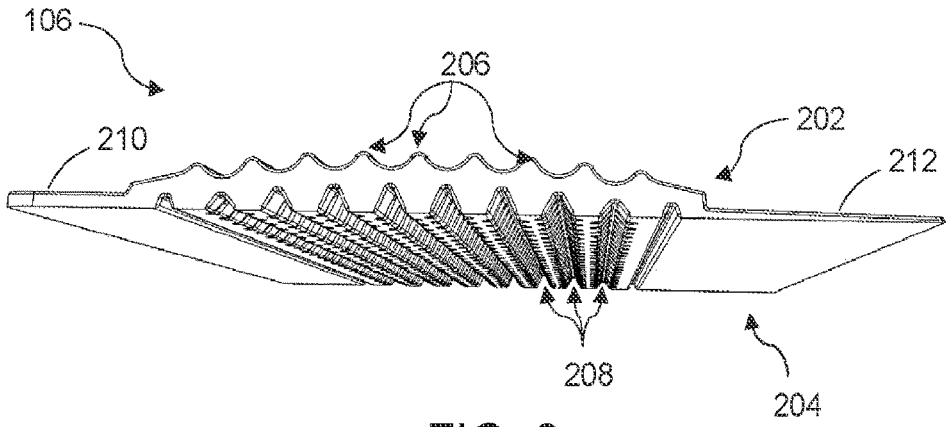
FIG. 2 illustrates the first support structure of FIG. 1 in accordance with one embodiment.

FIG. 2 illustrates a side view of the support structure 106 of FIG. 1 in accordance with one embodiment. The support structure 106 may include a first side 202 to support a user, and a second side 204 that is opposite the first side 202. The second side 204 is configured to be in operable contact with a surface that is separate from the mat 100, such as the floor or ground.

The support structure 106 may be formed from one or more different types of materials. These may include, but are not limited to, silicon, rubber, natural rubber, TPE, PU, TPU, cork, or any other suitable material available now or invented hereafter. The support structure 106 may be formed from composites or combinations of various materials, including those listed above.

The first side 202 may have a tapered or raised shape, and may include a plurality of ridges 206 for receiving a portion of the user's body. For example, during use it may be common for a user to place their fingers, neck, hands, or feet on the ridges 206 or within the space between ridges 206. These ridges 206 may, among other benefits, also provide anti-slip functionality for a user during use. The ridges 206 may therefore offer advantages over a flat mat in preventing slippage such as if a user contacts the ridges 206 at an inclined angle, such as with their arms and hands while in a "downward dog" position, which is common in Yoga.

The height-to-width ratio of the ridges 206 may be chosen such that they feel compressible during use to provide comfort and a tactile experience for the user. The ridges 206 also allow for less material to be used, which results in material savings, reduced costs, and reduced weight.

The size or number of the ridges 206 may vary. In some embodiments, the size or number of the ridges 206 may be based on the size of the user. In some embodiments, the size or number of the ridges 206 may be based on the expected purpose(s) of the ridges 206 or the mat 100 in general. For example, it may be preferable to have a certain number of ridges 206 or to have ridges 206 of a certain size for one exercise, but preferable to have a different number of ridges 206 or have ridges 206 of a different size for another exercise.

Similarly, the size of the support structure 106 may vary. For example, wider support structures 106 may have more ridges 206 than smaller support structures 106.

The second side 204 may include a plurality of grooves 208, the space between which may contact a surface that is separate from the mat 100. For example, the space or structure between the grooves 208 may contact the floor or other type of ground surface.

The grooves 208 may be defined by a series of raised portions and a series of depressed portions, wherein a depressed portion is between each pair of raised portions. As discussed below, the depressed portions in effect create the grooves 208 or otherwise the negative space that may at least assist in allowing the support structure 106, and also the mat 100, to be maneuvered into a rolled configuration.

Figure 3:
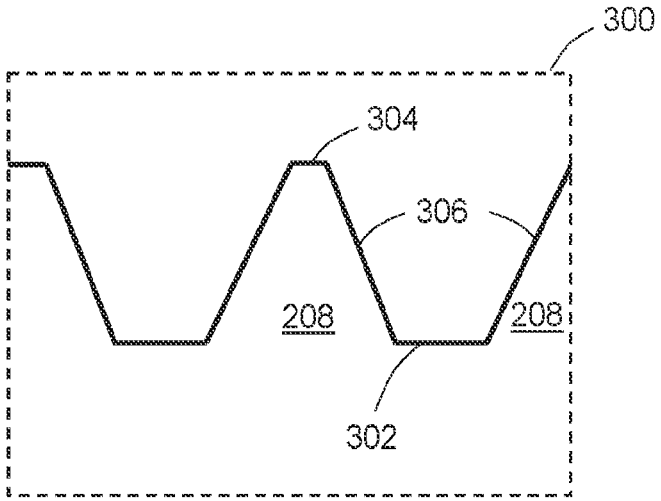
FIG. 3 illustrates a detailed view of grooves of the first support structure of FIG. 2 in accordance with one embodiment.

FIG. 3 illustrates a section 300 of the grooves 208 of FIG. 2 in accordance with one embodiment. The grooves 208 may include or otherwise be defined by a bottom portion 302, a top portion 304, and leg portions 306. During use, the bottom portions 302 may contact the surface that is separate from the mat 100, such as the floor.

The portions that define the grooves 208 of FIGS. 2 and 3 are illustrated as a trapezoid. However, the grooves 208 may be formed in any other appropriate shape or configuration. Similarly, the lengths or sizes of each of the bottom portion 302, top portion 304, the leg portions 306, and the angles formed therebetween may vary.

As seen in FIG. 3, these components also create grooves 208 between the bottom portions 302, top portion 304, and leg portions 306. As discussed below, the defined grooves 208 may at least assist in allowing the support structure 106, and also the mat 100, to be maneuvered into a rolled configuration.

The support structure 106 may be formed from a flexible material such that it can be in a rolled configuration—independently or while connected with a mat portion. For example, leg portions 306 that are opposite from each other across a negative space may move closer to each other or even contact each other while in a rolled configuration.

The size or number of the grooves 208 may vary. In some embodiments, the size or number of the grooves 208 may be based on the size of the user. In some embodiments, the size or number of the grooves 208 may be based on the expected purpose(s) of the support structure 106 or the mat 100 in general. For example, larger bottom portions 302 and shorter leg portions 306 may provide more structural support than smaller bottom portions 302 and longer leg portions 306.

Referring back to FIG. 2, the support structure 106 may also include one or more attachment portions 210 and 212. The attachment portion(s) 210 and 212 may be shaped and sized to attach to or otherwise operably connect with the mat portion 102. In some embodiments the attachment portions will have a hinged portion at the point of connection with the arched portion of bars. For example, mat portion 102 may be operably attached to at least a portion of the attachment portion 212.

In some embodiments, the support structures may be designed such that they can be stacked with each other. For example, a first support structure may be stacked on top of a second support structure. In this stacked configuration, the ridges of the second support structure may enter the grooves of the first structure or otherwise contact the portions that define the grooves of the first support structure.

Figure 4:
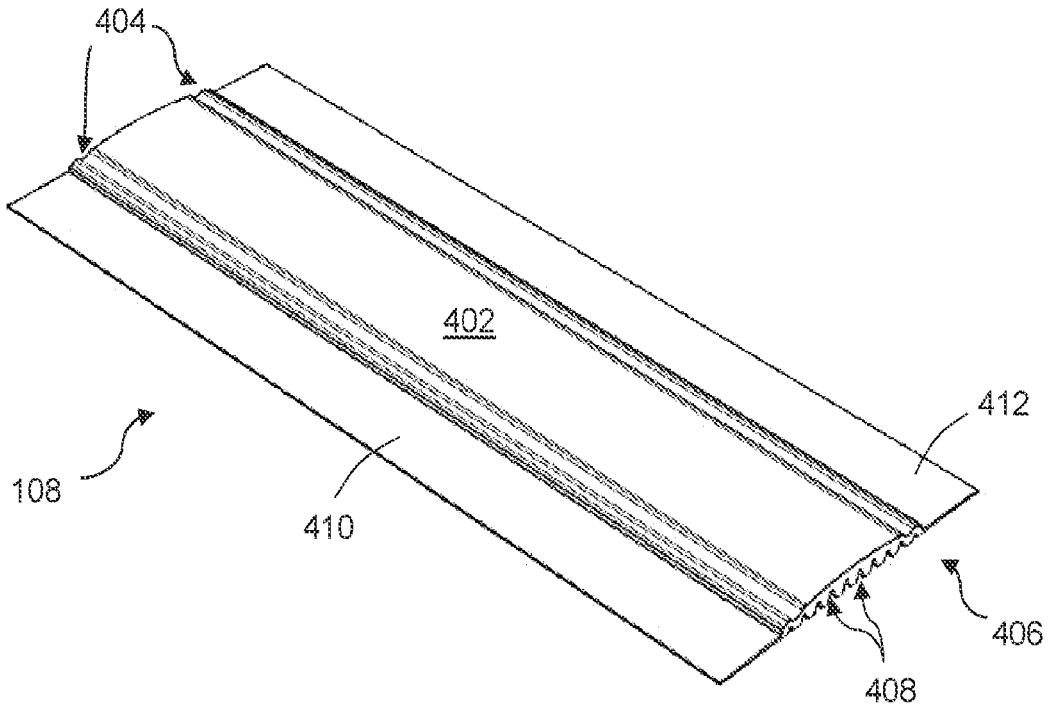
FIG. 4 illustrates the second support structure of FIG. 1 in accordance with one embodiment.

FIG. 4 illustrates a perspective view of the support structure 108 of FIG. 1 in accordance with one embodiment. The support structure 108 may be similar to support structure 106. However, the support structure 108 may include a top surface 402 that does not have ridges across the entirety of the top surface 402. The top surface 402 may instead have a substantially flat or otherwise smooth and/or cushioned surface. However, the top surface 402 may still have some ridges 404, such as at opposite ends of the top surface 402. As seen in FIG. 4, the ridges 404 may run the length of the top surface 402.

Similar to the support structure 106, the support structure 108 may have a second surface 406 that is opposite the first surface 402 and configured to contact a surface that is separate from the mat 100 (e.g., the floor). The second surface 406 may include a plurality of grooves 408, which may be similar to the grooves 208 of FIG. 2.

Similar to the support structure 106, the support structure 108 may include one or more attachment portions 410 to attach to or otherwise operably connect with the mat portion 102 and, as in FIG. 1, mat portion 104. For example, mat portion 102 may be operably connected to at least a portion of the attachment portion 410, and mat portion 104 may be operably connected to at least a portion of attachment portion 412.

Figure 5:
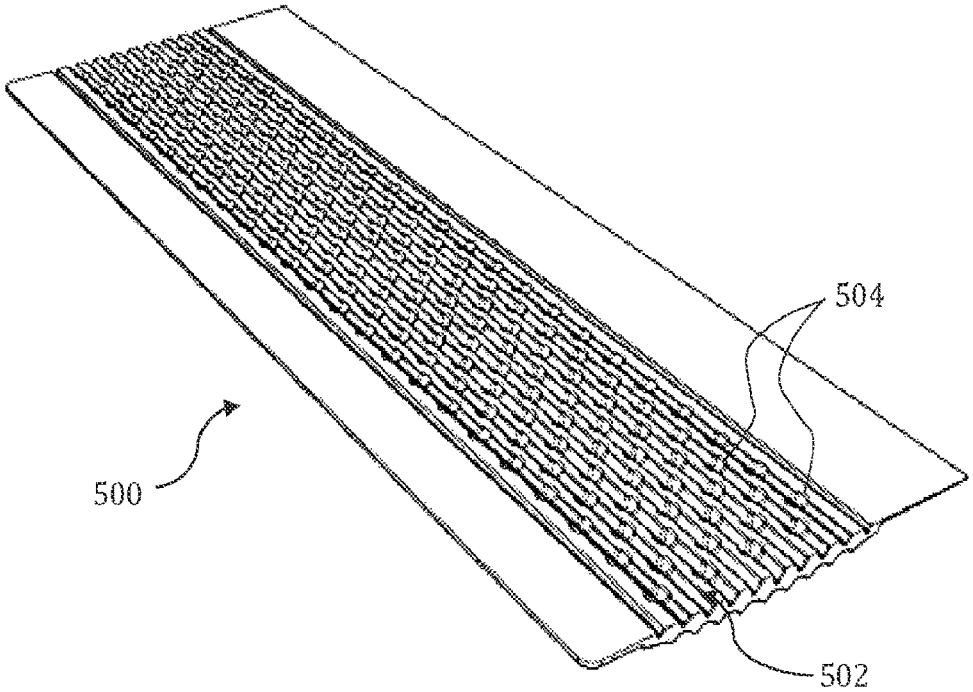
FIG. 5 illustrates a support structure with gripping elements in accordance with one embodiment.

FIG. 5 illustrates a bottom surface of a support structure 500 in accordance with one embodiment. As in the previous figures, the support structure 500 may include a plurality of grooves 502, which may be similar to the grooves 208 of FIG. 2.

In some embodiments, such as in FIG. 5, the support structures 500 may include a plurality of gripping elements 504. The gripping elements 504 may provide some level of grip to keep the support structure 500 in place during use such as on the floor or other type of surface, but to also allow intentional movement, such as if the user wants to pick up or move the support structure 500.

The gripping elements 504 may include suction elements, self-adhesive rubber portions, or any other type of gripping elements whether available now or invented hereafter as long as the features of the described embodiments may be accomplished. The number, placement, shape, and size of the gripping elements 504 may vary, and may depend on the intended use of the support structure 500 or a mat in general.

Figure 6:
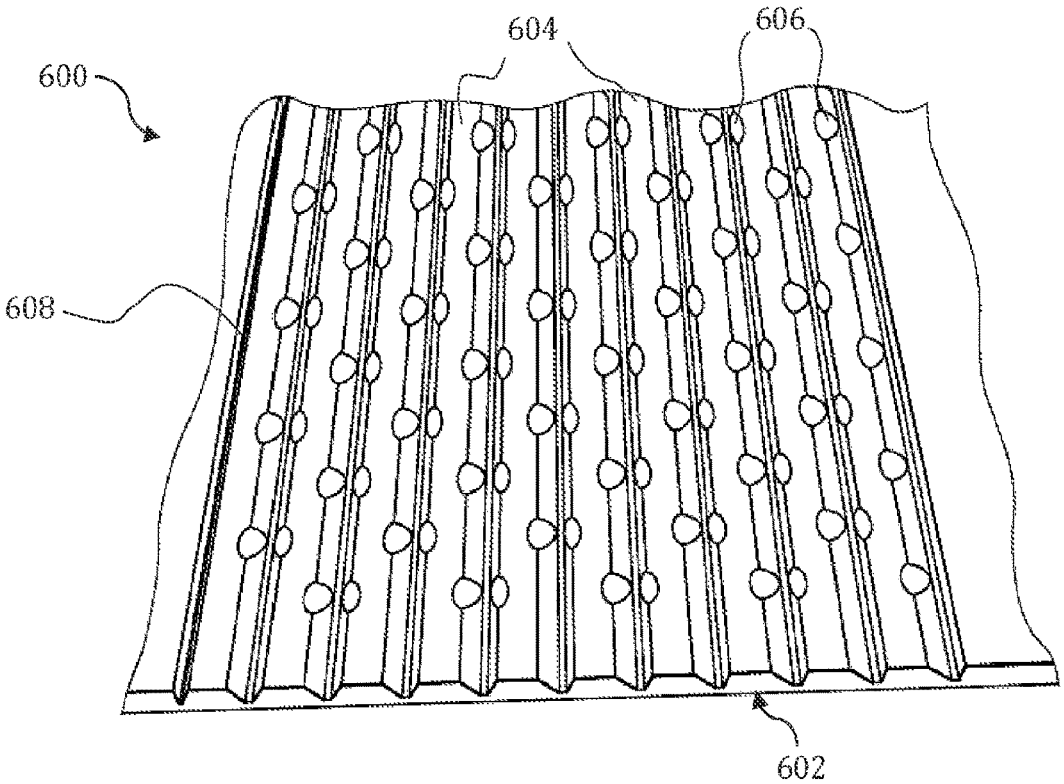
FIG. 6 illustrates a support structure with a hinged portion in accordance with one embodiment.

FIG. 6 illustrates a detailed view of a support structure 600 in accordance with one embodiment. Specifically, FIG. 6 illustrates a portion of the bottom surface 602 of the support structure 600 that is configured to contact a surface that is separate from a mat portion. The bottom surface 602 may include a plurality of grooves 604 as discussed previously, as well as a plurality of concave portions or cavities 606 in structural portions to create additional negative space. This further facilitates the flexibility of the support structure 600 to allow the support structure 600 to be maneuvered into a rolled configuration and also maintain structural support for the user during use.

The support structure 600 may also include a hinged portion 608 to at least enhance the flexibility of the support structure 600. The hinged portion 608 may be characterized by a reduced thickness in material in the area adjacent to an attachment portion (not shown in FIG. 6). The hinged portion 608 may at least assist in enabling the support structure 600 to be in a rolled configuration and improves the flexibility at the location between the mat portion (not shown in FIG. 6) and the support structure. Additionally, the hinged portion 608 of may include a section of reduced thickness on either or both sides of the support structure 600 at an attachment portion. The hinged portion(s) 608 may also allow a user to initiate or otherwise facilitate the rolling of the mat by allowing an attachment portion to lay at least substantially flat when the mat is in an unrolled configuration. Otherwise, the attachment portion may rise off the floor.

Figure 7:
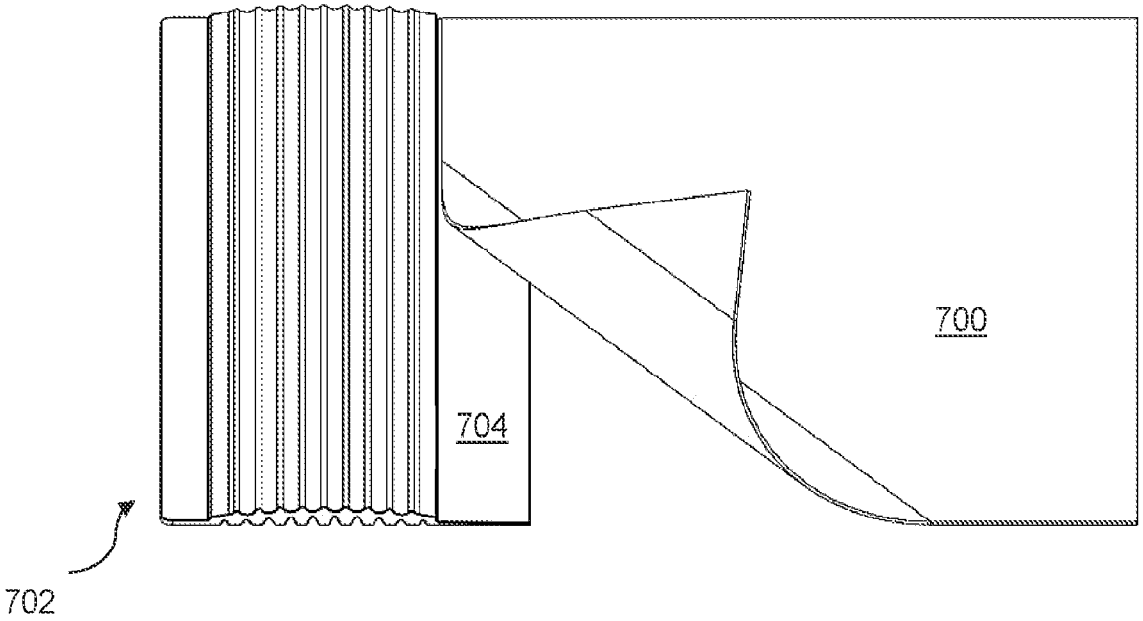
FIG. 7 illustrates mat portion being operably connected to a support structure in accordance with one embodiment.

Mat portion(s) may be connected to a support structure in a variety of ways. FIG. 7 illustrates a mat portion 700 being placed on a support structure 702 in accordance with one embodiment. Specifically, the mat portion 700 is being placed on an attachment portion 704 of the support structure 702. The mat portion 700 may be similar to the mat portions 102 and 104 of FIG. 1, and the support structure 702 may be similar to the support structures 106 or 108 discussed previously.

In the embodiment shown in FIG. 7, the attachment portion 704, the mat portion 700, or both, may be coated with an adhesive such as glue or epoxy. However, other connection means may be used in accordance with the described embodiments such as, but not limited to, stitching, hook-and-loop fasteners, zippers, straps, heat-fused techniques, or any other type of connection means whether available now or invented hereafter. In some embodiments, a support structure and a mat portion could be a single structure where the support structure and the mat portion are formed as a single piece.

In some embodiments, the mat portion 700 may cover the entirety of the attachment portion 704. In some embodiments, the mat portion 700 may cover only a portion of the attachment portion 704.

Depending on the connection means used, the mat portion 700 and the support structure 702 may be removably secured with each other. For example, in the case non-permanent or semi-permanent connection means such as of hook-and-loop fasteners, magnet, or rivets, a user may attach different types of support structures to a mat portion 700 at different times.

As discussed previously, the aforementioned grooves and ridges allow the support structures and mat portions to be maneuvered into a rolled configuration. This can be particularly useful for exercise mats, as users often carry their mats to and from studios, gyms, parks, or other types of fitness areas. As exercise mats can be over 10 $ft^2$, it is impractical for users to carry them in an "open" or unrolled or unfolded position. Accordingly, users may roll their mats to reduce the overall volumetric footprint of the mat during transport and for storage.

This is opposed to existing equipment, in which padding or cushions are placed directly on the mat. These additional pads or cushions prevent the mat from being rolled into a compact, rolled orientation or configuration that a user may expect.

Figure 8A:
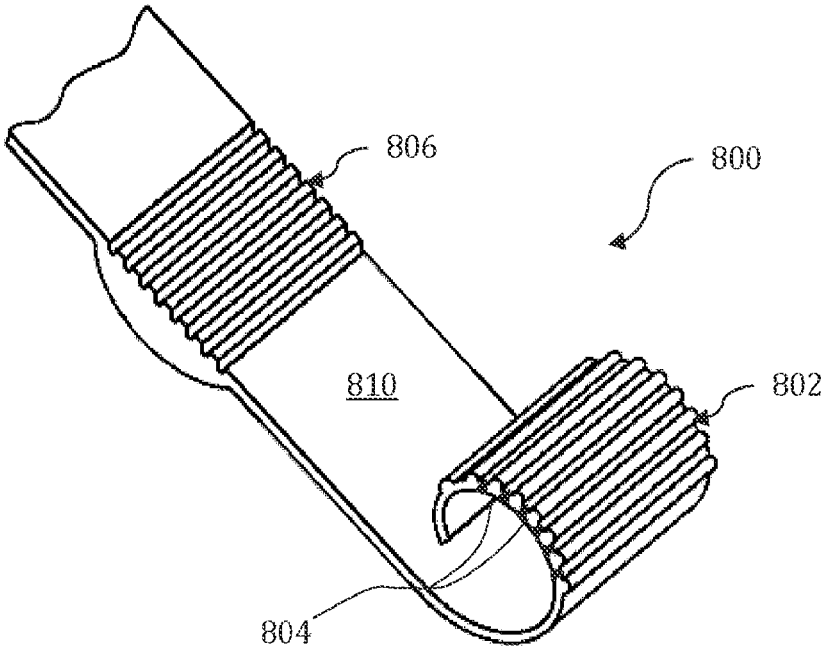
FIGS. 8A & 8B illustrate a mat being maneuvered into a rolled configuration in different ways in accordance with one embodiment.

FIG. 8A illustrates a mat 800 being maneuvered into a rolled configuration in accordance with one embodiment. For example, a user may begin rolling the mat at one end, starting with support structure 802. The grooves 804 allow the support structure 802, and therefore the mat 800, to be rolled more tightly than would be otherwise (e.g., if cushions were placed directly onto the mat or onto a mat portion).

Although FIG. 8A illustrates the mat 800 being maneuvered into a rolled configuration starting at an end such that the support structure 802 would first contact the bottom surface 810, a user may roll the mat 800 in other ways. For example, the mats in accordance with the described embodiments may roll from either direction. Similarly, a user may maneuver the described mats into the rolled configuration regardless of whether the user starts with the mat face down on the floor (i.e., upside down) or with the mat faceup as it would be during use.

Figure 8B:
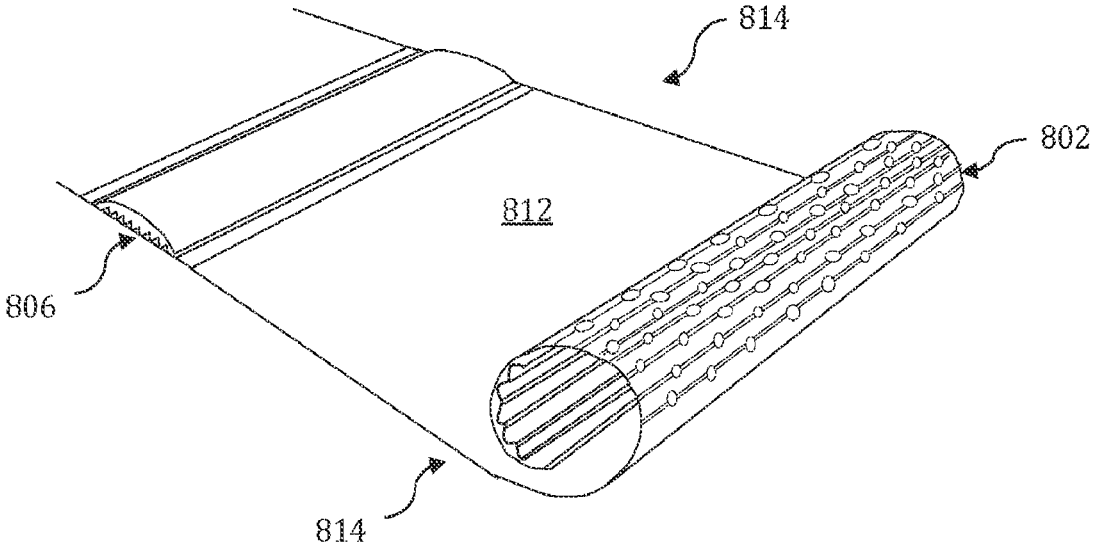

For example, FIG. 8B illustrates the mat 800 of FIG. 8A being maneuvered into a rolled configuration. In FIG. 8B, however, the mat 800 is initially positioned such that the top surface 812 of the mat is facing upward (e.g., as it would be during use). As seen in FIG. 8B, a user may begin maneuvering the mat 800 into a rolled configuration such that the support structure 802 would contact the top surface 812. In this scenario, the ridges 814 such as the ridges described previously would allow the mat 800 to be maneuvered into a rolled configuration.

Figure 9:
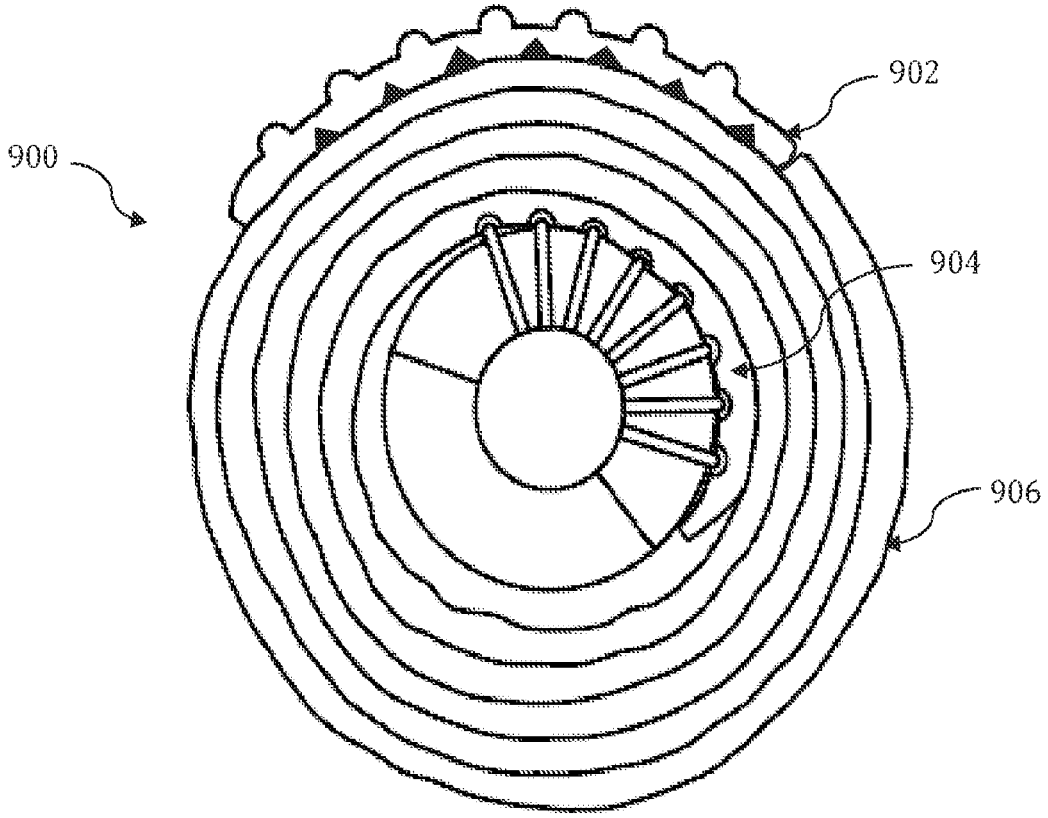
FIG. 9 illustrates a mat in a rolled configuration in accordance with one embodiment.

FIG. 9 illustrates a mat 900 in a rolled configuration. The mat 900 includes support structures 902 and 904, and one or more mat portions 906. As can be seen in FIG. 9, the support structures 902 and 904 can roll or be rolled at a rate that is similar to that of the mat portions 906 such that mat 900 can be rolled as it would be rolled if the mat 900 were formed from a single piece.

As discussed previously, this is opposed to existing mats, such as those with cushions directly attached to or on the mat. Although a user could fold or roll these mats to an extent, these cushions would prevent these existing mats from being rolled as neatly and compact as if the existing mat was made from and included only a single, uniform material.

Users of mats such practitioners of mat exercises are used to rolling a mat for transport and storage. The mats in accordance with the described embodiments provide one or more support structures as described herein to be operably connected to the mat and allow the user to roll their mat in the way they are accustomed.

The support structure(s) described herein may be manufactured in a variety of ways. For example, in some embodiments, the support structure(s) may be manufactured via injection mold-based techniques.

Although the present application discusses different types of support structures and support structures with different features, the support structures described herein may be interchangeable with each other. For example, the support structures of FIGS. 5 and 6 may be used in conjunction with the mat portions 102 and 104 of FIG. 1.

The methods, systems, and devices discussed above are examples. Various configurations may omit, substitute, or add various procedures or components as appropriate. For instance, in alternative configurations, the methods may be performed in an order different from that described, and that various steps may be added, omitted, or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

A statement that a value exceeds (or is more than) a first threshold value is equivalent to a statement that the value meets or exceeds a second threshold value that is slightly greater than the first threshold value, e.g., the second threshold value being one value higher than the first threshold value in the resolution of a relevant system. A statement that a value is less than (or is within) a first threshold value is equivalent to a statement that the value is less than or equal to a second threshold value that is slightly lower than the first threshold value, e.g., the second threshold value being one value lower than the first threshold value in the resolution of the relevant system.

Specific details are given in the description to provide a thorough understanding of example configurations (including implementations). However, configurations may be practiced without these specific details. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of various implementations or techniques of the present disclosure. Also, a number of steps may be undertaken before, during, or after the above elements are considered.

Having been provided with the description and illustration of the present application, one skilled in the art may envision variations, modifications, and alternate embodiments falling within the general inventive concept discussed in this application that do not depart from the scope of the following claims.

What is claimed is:

1. A mat comprising:

a first mat portion including a top side and a bottom side opposite the top side; and a support bar including:

a first attachment portion configured to operably connect with a first section of the bottom side of the first mat portion such that the first section of the bottom side covers at least a portion of the first attachment portion, and a second section of the bottom side of the first mat portion contacts a surface separate from the mat during use, a first side adjacent to the first attachment portion and positioned to be contacted by a user during use, wherein the first side is formed as a raised surface with respect to the first attachment portion and is separate from the first attachment portion, a second side opposite the first side and configured to be in operable contact with the surface separate from the mat, wherein the second side includes one or more portions that define at least one groove to enable the support bar to be in a rolled configuration with the first mat portion, and a second attachment portion configured to operably connect with a second mat portion, wherein the first attachment portion and the second attachment portion are positioned on opposite sides of the first side of the support bar.

2. The mat of claim 1 wherein the first side includes a plurality of ridges to support the user.

3. The mat of claim 2 wherein the first side is compressible during support of the user, and the second side provides structural support during support of the user.

4. The mat of claim 1 wherein the first side includes a smooth portion to support the user.

5. The mat of claim 1 wherein the surface is a floor portion.

6. The mat of claim 1 further comprising a hinged portion between the first attachment portion and at least one of the first side or the second side to enable the support bar to be in the rolled configuration with the first mat portion.

7. The mat of claim 1 wherein the support bar is formed from at least one of thermoplastic elastomer, thermoplastic polyurethane, polyurethane, silicon, urethane, rubber, natural rubber, or cork.

8. The mat of claim 1 wherein the support bar and the first mat portion are operably connected via at least one of stitching, an adhesive, hook and loop fasteners, a mechanical attachment mechanism, magnets, or rivets.

9. The mat of claim 1 wherein the first side of the support bar is shaped as an arch.

10. The mat of claim 1 wherein the support bar further comprises at least one gripping element configured with the second side to removably secure the support bar to the surface.

11. The mat of claim 1 wherein the second side includes a plurality of portions that define a plurality of grooves between each of the portions to enable the support bar to be in the rolled configuration with the first mat portion.

12. The mat of claim 1 further comprising a second support bar including:

a first attachment portion configured to operably connect with a third section of the bottom side of the first mat portion, a first side adjacent to the first attachment portion and positioned to be contacted by a user during use, a second side opposite the first side and configured to be in operable contact with the surface separate from the mat during use, wherein the second side includes one or more portions that define at least one groove to enable the second support bar to be in a rolled configuration with the first mat portion and the support bar.

13. A support bar for a user, the support bar comprising:

a first attachment portion configured to operably connect with a first mat portion such that a first section of the first mat portion covers at least a portion of the first attachment portion and a second section of the first mat portion contacts a surface separate from the first mat portion during use;

a first side adjacent to the first attachment portion, the first side comprising an arched surface to support the user and be contacted by the user during use, wherein the first side is formed as a raised surface with respect to the first attachment portion and is separate from the first attachment portion;

a second side opposite the first side and including one or more portions that define at least one groove to enable the support bar to be in a rolled configuration, and a second attachment portion configured to operably connect with a second mat portion, wherein the first attachment portion and the second attachment portion are positioned on opposite sides of the first side of the support bar.

14. The support bar of claim 13 wherein the first attachment portion includes an attachment surface to operably connect with the first mat portion.

15. The support bar of claim 13 wherein the support bar is formed from at least one of thermoplastic elastomer, thermoplastic polyurethane, polyurethane, silicon, urethane, rubber, natural rubber, or cork.

16. The support bar of claim 13 further comprising a hinged portion to create a fold point between the first attachment portion and the first side or between the first attachment portion and the second side.

17. The support bar of claim 13 further comprising at least one gripping element configured with the second side to removably secure the support bar to the surface separate from the first mat portion.

* * * * *